428-408 SR
8/12/86 XR 4,605,581

United States Patent [19]
Stevens et al.

[11] Patent Number: 4,605,581
[45] Date of Patent: Aug. 12, 1986

[54] METHOD OF TREATING A CARBON CURRENT COLLECTION BRUSH BLANK AND BRUSH RESULTING THEREFROM

[75] Inventors: Robert W. Stevens, Bartonville, Pa.; Mark Markovitz, Schenectady, N.Y.

[73] Assignee: General Electric Company, Salem, Va.

[21] Appl. No.: 767,397

[22] Filed: Aug. 20, 1985

[51] Int. Cl.[4] ..... B44D 1/20; B44D 1/46
[52] U.S. Cl. ..... 428/96; 310/229; 310/249; 310/252; 310/253; 427/114; 428/408
[58] Field of Search ..... 427/372.2, 114; 310/229, 249, 252, 253; 428/408, 96

[56] References Cited

U.S. PATENT DOCUMENTS 3,841,906 10/1974 Grunewald et al. ..... 310/228

*Primary Examiner*—Marion C. McCamish
*Attorney, Agent, or Firm*—Arnold E. Renner

[57] ABSTRACT

A carbon current collection brush having improved wear characteristics and exhibiting a relatively low coefficient of friction at its sliding contact surface (e.g., with a commutator or slip ring) is made by impregnating a brush blank with a solution containing an organometallic compound and an organic resin. The thereby impregnated brush blank is then cured to remove volatiles and retain approximately one to nine percent, by weight, of the organometallic compound and the organic resin in the brush blank.

43 Claims, 1 Drawing Figure

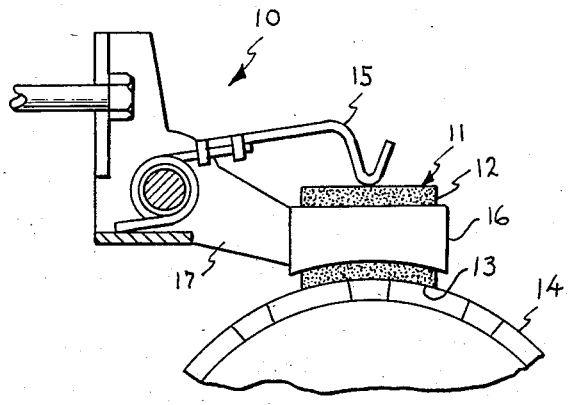
10
15
11
12
16
13
14
17

METHOD OF TREATING A CARBON CURRENT COLLECTION BRUSH BLANK AND BRUSH RESULTING THEREFROM

BACKGROUND OF THE INVENTION

The present invention relates generally to carbon brushes for use as current collectors in dynamoelectric machines and, more particularly, to a method of treating blanks for such brushes and the brushes resulting therefrom, such brushes exhibiting enhanced wear characteristics particularly at high temperature and low humidity.

Carbon current collection brushes are employed in rotating brush-type machines in which the brush blanks are generally fabricated of carbon, a relatively poor electrical conductor, reinforced by other materials and graphitized. For example, carbon is mixed with a pitch binder and the mixture is graphitized. The blanks are then assembled into brushes. These brushes are referred to as carbon current collection brushes or merely carbon brushes.

The above types of carbon brushes are retained in position by brush holders which generally are in the form of square, rectangular or cylindrical sleeves serving as a guide for any radial motion of brush resulting from vibration or eccentricity of the armature (commutator or slip ring) and brush wear. The brush holder may be mounted on a bracket to maintain a rigid position spaced from the commutator surface. An adjustable spring, connected to the bracket, bears on the top surface of the brush to maintain the desired contact pressure of the bottom surface of the brush on the commutator segments or slip ring.

The wear rate of a carbon brush in a dynamoelectric machine increases very rapidly with increasing temperature. For example, the life of a typical carbon brush under a standard load of 100 amperes per square inch (APSI) for a brush wear of 250 mils, decreases from about 8,500 hours at 100° C. to about 700 hours and 200° C. An important contributing factor to increased brush wear at elevated temperatures is direct oxidation of the carbon brush surface at the sliding contact interface leading to loss of carbon as gaseous oxides. This oxidation is catalyzed by the presence of copper in the commutator or slip ring. Minute particles of copper oxide migrate along the basal planes of the graphite crystallites into the interior of the brush producing a catalytic effect that leads to enhanced gasification rates and to increased brush porosity. Various approaches have been employed in attempts to overcome rapid brush wear, including the use of lubricants.

One method of increasing brush life by decreasing wear is found in U.S. Pat. No. 3,841,906 "Method of Treating a Carbon Current Collection Brush Blank and Brush Resulting Therefrom" by Albert L. Grunewald et al., issued Oct. 15, 1974, which patent is assigned to assignee of the present invention and which patent is hereby specifically incorporated by reference. The above patent describes a treatment method and resultant brush with enhanced wear characteristics, particularly at high temperature and low humidity. The method defined by the Grunewald et al. patent calls for impregnating a brush blank by contacting that blank with a solution of zinc naphthenate and then curing the blank by air drying and heating to remove solvents and retain zinc naphthenate in the blank in the amount of approximately four to six percent by weight of the total blank.

The brush described and made in accordance with the method of U.S. Pat. No. 3,841,906 is superior in many respects to an untreated blank. It has been found, however, to exhibit a relatively high coefficient of friction between the brush and motor commutator (or slip ring) particularly under low load, low current operation of the dynamoelectric machine. This high friction condition can result in "chattering" of the brush in its holder with resultant poor commutation (including sparking) which could ultimately result in damage to the machine part, particularly the commutator or slip ring.

SUMMARY OF THE INVENTION

It is, therefore, an object of the present invention to provide an improved method of treating a carbon brush blank and to provide an improved brush resulting therefrom.

It is an additional object to provide an improved method of treating a carbon brush blank to provide a brush which exhibits improved wear characteristics, particularly at elevated temperatures and low humidity, and which also exhibits a relatively low coefficient of friction between the brush and a contacting surface.

It is a further object to provide an improved method of treating a carbon brush blank to provide an improved carbon collector brush by impregnating the blank with an organometallic compound and an organic resin.

It is still another object to provide an improved method of treating a carbon brush blank and to the improved brush resulting therefrom by impregnating the brush blank with a solution of zinc naphthenate and organic resin and baking the brush to remove volatile solvents and cure the resin to provide a brush having approximately one to nine percent by weight of zinc naphthenate and resin.

The foregoing and other objects are achieved in accordance with the present invention by contacting a carbon brush blank with a solution containing an organometallic compound and an organic resin to thereby impregnate the brush with the solution. The brush is then baked to remove solvents and cured to retain the organometallic compound and resin in the blank at approximately one to nine percent of the weight of the brush blank. The brush resulting from the method has been found to have improved wear characteristics and low friction at its contacting surface.

BRIEF DESCRIPTION OF THE DRAWING

While the present invention is described in particularity in the claims annexed to and forming a part of this specification, a better understanding thereof can be had from the following description taken in conjunction with the accompanying drawing which is a side elevational view, partially in section, of a carbon brush such as is made in accordance with our invention provided within a brush holder assembly.

DETAILED DESCRIPTION

Before beginning a description of the method of treating the carbon brush and the brush resulting therefrom, reference is made to the drawing which sets forth a suitable environment for use of the brush in accordance with the present invention. In the FIGURE, there is shown a single brush holder assembly 10 including the improved carbon current collection brush 11. Brush 11 comprises a body portion 12 and a lower surface portion 13 which surface is in contact with or rides on the surface of a commutator (or a slip ring) 14 due to the force of the spring applied by a brush spring 15 against the top portion 12 of the brush 11. Brush 11 is maintained in the desired position relative to the commutator (slip ring) 14 by means of a brush holder 16 which is held in fixed position spaced from the surface of commutator 14 by means of a bracket 17. Brush holder 16 is shown of conventional design, comprising a rectangular sleeve fabricated of high strength metal and serves as a guide for any radial motion of the brush 11 resulting from vibration or eccentricity of the armature or commutator and wear of the brush. For purposes of simplicity, a flexible copper cable generally described as a brush shunt or pig tail employed for directing current from the carbon brush to the brush holder, is not illustrated but can be employed as desired.

As is known and earlier alluded to, due to friction and other effects, as the brush 11 rides upon the rotating commutator 14, there is wear associated with the brush which is a function of a number of factors, primarily temperature, humidity and the coefficient of friction between the brush and the commutator or slip ring.

It is the purpose of the present invention to provide a method of treatment and the resultant brush to provide the requisite current carrying capability of the brush while providing improved wear characteristics thereof. The current collection carbon brush in accordance with the present invention is made by impregnating a brush blank with a treating solution comprising an organometallic compound and a an organic resin, diluted with appropriate solvents, and subsequently curing the blank, preferably first by air drying and then by heating, to remove volatiles (e.g., solvents) and cure the resin to retain organometallic compound and resin in the resultant brush in the amount of approximately one to nine percent by weight of the brush.

The organometallic compounds employed in the present invention are preferably organometallic salts of the carboxylate family of the metals: zinc, calcium, cobalt, lead, manganese and zirconium. The carboxylates preferred are selected from naphthenate, octoates, tallates. A preferred embodiment of the invention employs a metal carboxylate solution having a metal content of from 5 to 40 percent. A zinc naphthenate solution containing from 8 to 16 percent zinc is, at the present, most preferred.

The organic resins preferred are epoxy and phenolic resins. In the category of epoxy resins, that preferred is a resin having 1, 2 epoxy groups and having more than one epoxy group per molecule. The epoxy resins thus include cycloaliphatic epoxy resins, such as 3,4-epoxycyclohexylmethyl-(3,4-epoxy)cyclohexane carboxylate (sold under the trademarks ERL 4221 by Union Carbide Plastics Company or Araldite CY 179 by Ciba Products Company); bis (3,4-epoxy-6-methylcyclohexymethyl) adipate (sold under the trademarks ERL 4289 by Union Carbide Plastics Company or Araldite CY 178 by Ciba Products Company); vinylcyclohexene dioxide (ERL 4206 made by Union Carbide Plastics Company); bis (2,3 -epoxycyclopentyl) ether resins (sold under the trademark ERL 4205 made by Union Carbide Plastics Company); 2-(3,4-epoxy) cyclohexyl-5,5-spiro (3,4-epoxy)cyclohexane-m-dioxane (sold under the trademark Araldite CY 175 by Ciba Products Company); glycidyl ethers of polyphenols epoxy resins, such as liquid or solid bisphenol A diglycidyl ether epoxy resins (such as those sold under trademarks as Epon 826, Epon 828, Epon 830, Epon 1001F, Epon 1002F, Epon 1004F, etc., by Shell Chemical Company); phenolformaldehyde novolac polyglycidyl ether epoxy resins (such as those sold under the trademarks DEN 431, DEN 438, and DEN 439 by Dow Chemical Company); epoxy cresol novolacs (such as those sold under the trademarks ECN 1235, ECN 1273, ECN 1280 and ECN 1299 by Ciba Products Company); resorcinol glycidyl ether (such as ERE 1359 made by Ciba Products Company); tetraglycidoxy tetraphenylethane (Epon 1031 made by Shell Chemical Company); glycidyl ester epoxy resins such as diglycidyl phthalate (ED-5661 sold by Celanese Resins Company); diglycidyl tetrahydrophthalate (Araldite CY 182 by Ciba Products Company); and diglycidyl hexahydrophthalate (Araldite CY 183 made by Ciba Products Company or ED-5662 made by Celanese Resins Company); and flame retardant epoxy resins such as halogen containing bisphenol A diglycidyl ether epoxy resins (e.g., DER 542 and DER 511 which have bromine contents of 44–48 and 18–20 percent, respectively, and are made by Dow Chemical Company). Moreover, it often is advantageous to employ mixtures of these epoxy resins; e.g., a glycidyl ether epoxy resin such as Epon 828 with a cycloaliphatic epoxy resin such as ERL 4221.

When a phenolic resin is used in the present invention, it can be any of those based upon reacting formaldehyde with phenol, cresols, furan, butyl phenols, catechol, resorcinol or mixtures of these compounds. The phenolic resin can also be modified such as with an epoxy resin, a rubber or an oil. Examples of these phenolic materials are CRJ 406, FRJ 425, FRJ 774, HRJ 1166, HRJ 1461, HRJ 1871, HRJ 2148, HRJ 254, SG 3350 and SG 3378 made by Schenectady Chemicals Inc. (Schenectady, N.Y.) and Varcum phenolic and furan resins made by Reichold Chemicals, Inc. (White Plains, N.Y.).

The preferred process for treating the brush blank in accordance with the present invention involves disolving the solid resins and diluting liquid resins with appropriate volatile solvents such as alcohol, toluene, alcohol/toluene, methyl ethyl ketone, acetone, etc., to achieve a desired specific gravity for treating the brush. In accordance with the present invention, the preferred solution specific gravity is in the range of from 0.900 to 1.020 at 21° C. The brush blank is then placed into a vacuum pressure vessel and a vacuum of about 28 inches of mercury or better is applied for approximately 30 minutes. With the material still under vacuum, the treating solution is drawn into the vessel to completely cover the blank. With the carbon pieces completely submerged in the solution, atmospheric pressure is then applied for approximately one-half hour to cause the solution to completely impregnate the carbon. In cases of blanks greater than approximately one inch in thickness, it is often advisable to apply nitrogen at a pressure of approximately 45 pounds per square inch gauge for approximately one-half hour to speed the impregnation process.

Following the pressure period, the carbon pieces are removed from the solution, drained and allowed to air dry for approximately 16 to 24 hours. After air drying, a heat treatment is applied to effect the final curing of the brush. Preferably, this treatment involves heating from about 30° C. to 220° C. at a rate of increase of about 20° C. per hour. Once the brush reaches 220° C., it is held at that temperature for approximately 12 hours at which time the curing process is complete.

The following teaching examples are included as illustrative of the invention. It is to be specifically noted that Example A falls within the teachings of the aforementioned U.S. Pat. No. 3,841,906 and not the present invention. It is included here for purposes of illustration and comparison. The curing process used in all cases was in accordance with that described above. "Pick up" as used in the following examples refers to the weight percentage of the treating materials to the total brush weight after curing. Treating solution percentages are on a "by weight" basis.

EXAMPLE A (U.S. Pat. No. 3,841,906)

A treating solution having a specific gravity of 0.908 at 27° C. was made from 69.5% of zinc naphthenate solution containing 10% zinc and 30.5% of toluene. The pick up was 3.5–5%.

EXAMPLE B

A treating solution having a specific gravity of 1.016 at 20° C. was made from 62.9% of the cycloallphatic epoxy resin ERL 4221, 7.0% of zinc napthenate solution containing 10% zinc and 30.1% methyl ethyl ketone. The pick up was 6–9%.

EXAMPLE C

A treating solution having a specific gravity of 0.952 at 23° C. was made from 24.8% of furan modified phenol-formaldehyde resin HRJ 2148, 24.8% of a zinc naphthenate solution containing 10% zinc and 50.4% of denatured ethyl alcohol/toluene (50/50 by volume). The pick up was 4–7%.

EXAMPLE D

A treating solution having a specific gravity of 0.928 at 21° C. was made from 24.8% of rubber modified phenol-formaldehyde resin HRJ 2630, 24.8% of zinc naphthenate solution containing 10% zinc and 50.4% denatured ethyl alcohol/toluene (50/50 by volume). The pick up was 4–7%.

The test results for the brushes described in Examples A to D are summarized in Table I below.

TABLE I

| | TEST DATA | | | | |
|---|---|---|---|---|---|
| | | | WEAR RATE (MILS/HR) | | |
| | | | AMBIENT: 50% REL. HUMIDITY | | |
| EXAMPLE | FRICTION COEFF | | CONTROLLED BRUSH TEMP 150° C. | UNCONTROLLED BRUSH TEMP | AMBIENT −40° C. DPT |
| BRUSH CURRENT → | NO LOAD | 100 APSI | 100 APSI | 150 APSI | 100 APSI |
| A | 0.56 | 0.37 | 0.08 | 0.09 | 0.18 |
| B | 0.21 | 0.11 | 0.09 | 0.22 | 0.14 |
| C | 0.18 | 0.18 | 0.12 | 0.17 | 0.15 |
| D | 0.24 | 0.22 | 0.15 | 0.07 | 0.12 |

From Table I above, it is seen that a carbon current collection brush in accordance with the present invention (Examples B–D) exhibits a reduced coefficient of friction while retaining the improved wear characteristics of the zinc napthenate treated brush described in the aforementioned patent (Example A).

It has been further found that the improved characteristics of the present invention can be experienced over a wide range of proportions in the treating solutions. Table II below illustrates this:

TABLE II

| TREATING SOLUTION | | TEST DATA | | | | |
|---|---|---|---|---|---|---|
| | | | | WEAR RATE (MILS/HR) | | |
| | | | | AMBIENT: 50% REL. HUMIDITY | | |
| ZN NAPTH. (10% ZN) | RUBBER MOD. PHENOL-FORMALDEHYDE | FRICTION COEFF | | CONTROLLED BRUSH TEMP 150° C. | UNCONTROLLED BRUSH TEMP | AMBIENT −40° C. DPT |
| BRUSH CURRENT → | | NO LOAD | 100 APSI | 100 APSI | 150 APSI | 100 APSI |
| 10% | 90% | 0.29 | 0.22 | 0.170 | 0.373 | 0.25 |
| 25% | 75% | 0.30 | 0.16 | 0.084 | 0.73 | 4.20 |
| 50% | 50% | 0.24 | 0.22 | 0.152 | 0.70 | 0.125 |
| 75% | 25% | 0.20 | 0.18 | 0.086 | 0.325 | 0.14 |

While there have been shown and described what are at present considered to be the preferred embodiments of the invention, modifications thereto will readily occur to those skilled in the art. It is not desired, therefore, that the invention be limited to the specific arrangements shown and described, but it is intended to cover in the appended claims all such modifications as fall within the true spirit and scope of the invention.

What is claimed:

1. A method of treating a carbon current collection brush blank comprising the steps:

(a) contacting said brush blank with a solution containing an organometallic compound and an organic resin to thereby impregnate said brush blank with said solution.

(b) curing the impregnated brush blank to remove volatiles and retain approximately one to nine percent by weight of organometallic compound and organic resin in said brush blank.

2. The invention in accordance with claim 1 wherein said organometallic compound is a soluble organometallic salt.

3. The invention in accordance with claim 2 wherein said salt is a carboxylate.

4. The invention in accordance with claim 3 wherein said carboxylate is selected from the group comprising naphthenate, tallate and octoate.

5. The invention in accordance with claim 2 wherein said organometallic salt is a carboxylate of the group of metals including zinc, calcium, cobalt, lead, manganese and zirconium.

6. The invention in accordance with claim 2 wherein said organometallic salt is zinc naphthenate.

7. The invention in accordance with claim 1 wherein said organic resin is either an epoxy resin, a phenolic resin or a combination thereof.

8. The invention in accordance with claim 1 wherein said organic resin comprises an epoxy resin having 1, 2 epoxy groups and having more than one epoxy group per molecule.

9. The invention in accordance with claim 1 wherein said organic resin includes a phenolic resin based upon reacting formaldehyde with phenol, cresols, furan, butyl phenols, catechol or resorcinol.

10. The invention in accordance with claim 1 wherein said organometallic compound is zinc naphthenate and said organic resin is the epoxy resin 3,4-epoxycyclohexyl methyl-(3,4-epoxy) cyclohexane carboxylate.

11. The invention in accordance with claim 10 wherein said solution comprises, in approximate percentage by weight:

Zinc naphthenate—7.0%
Epoxy resin—62.9%
Solvent—30.1%.

12. A carbon current collection brush produced by the method of claim 11.

13. The invention in accordance with claim 1 wherein said organometallic compound is zinc naphthenate and the organic resin is a furan modified phenolic resin.

14. The invention in accordance with claim 13 wherein said solution comprises, in approximate percentage by weight:

Zinc Naphthenate—24.8%
Phenolic resin—24.8%
Solvent—50.4%.

15. A carbon current collection brush produced by the method of claim 14.

16. The invention in accordance with claim 1 wherein said organometallic compound is zinc naphthenate and said organic resin is a rubber modified phenolic resin.

17. A carbon current collection brush produced by the method of claim 16.

18. The invention in accordance with claim 16 wherein said solution comprises in approximate percentage by weight:

Zinc Naphthenate—24.8%
Phenolic resin—24.8%
Solvent—50.4%.

19. A carbon current collection brush produced by the method of claim 18.

20. The invention in accordance with claim 1 wherein the steps of curing includes the steps of air drying followed by baking.

21. A carbon current collection brush produced by the method of claim 20.

22. The invention in accordance with claim 20 wherein said baking comprises heating the impregnated brush blank from approximately 30° C. to 220° C. at a rate of increase of approximately 20° C. per hour and maintaning at 220° C. for approximately twelve hours.

23. A carbon current collection brush produced by the method of claim 22.

24. The invention in accordance with claim 1 wherein said brush blank is impregnated by contacting said blank with said solution under vacuum conditions.

25. A carbon current collection brush produced by the method of claim 24.

26. The invention in accordance with claim 1 wherein said brush blank is impregnated by first contacting said blank with said solution under vacuum conditions and subsequently under pressure conditions.

27. A carbon current collection brush produced by the method of claim 26.

28. A method of treating a carbon current collection brush blank comprising the steps:

(a) contacting said brush blank with a solution containing an organometallic compound and an organic resin to thereby impregnate said brush blank with said solution.

(b) curing the impregnated brush blank to remove volatiles and retain approximately one to nine percent by weight of organometallic compound and organic resin in said brush blank.

29. The invention in accordance with claim 28 wherein solvents are added to reduce the solution viscosity to a specific gravity of from approximately 0.900 to 1.020 at about 21° C.

30. The invention in accordance with claim 28 wherein said solution comprises, in approximate percentage by weight:

10% zinc naphthenate solution,
90% epoxy resin, and methyl ethyl ketone solvent to achieve a specific gravity of 0.900–1.020 and a pick up of one to nine percent, by weight after curing.

31. The invention in accordance with claim 28 wherein said solution comprises, in approximate percentage by weight:

50% zinc naphthenate solution,
50% phenolic resin, and denatured ethyl alcohol/toluene (50/50 by volume) to achieve a specific gravity of 0.900–1.020 and a pick up of one to nine percent by weight after curing.

32. A current collection brush for use with dynamoelectric machines comprising a carbon brush blank impregnated with the combination of an organometallic compound and an organic resin wherein the impregnating materials constitute approximately one to nine percent of the total weight of the brush.

33. The invention in accordance with claim 32 wherein said organometallic compound is a soluble organometallic salt.

34. The invention in accordance with claim 33 wherein said salt is a carboxylate.

35. The invention in accordance with claim 34 wherein said carboxylate is selected from the group comprising naphthenate, tallate and octoate.

36. The invention in accordance with claim 33 wherein said organometallic salt is a carboxylate of the group of metals comprising zinc, calcium, cobalt, lead, manganese and zirconium.

37. The invention in accordance with claim 33 wherein said organometallic salt is zinc naphthenate.

38. The invention in accordance with claim 32 wherein said organic resin comprises either an epoxy resin a phenolic resin or a combination thereof.

39. The invention in accordance with claim 32 wherein said organic resin comprises an epoxy resin having 1, 2 epoxy groups and having more than one epoxy group per molecule.

40. The invention in accordance with claim 32 wherein said organic resin includes phenolic resin selected from the group comprising phenol-formaldehyde, cresolformaldehyde and one based on reacting formaldehyde with furan, butyl phenol, catechol or resorcinol.

41. The invention in accordance with claim 32 wherein said organometallic compound is zinc naphthenate and said organic resin is the epoxy resin 3,4-epoxycyclohexylmethyl-(3,4-epoxy) cyclohexane carboxylate.

42. The invention in accordance with claim 32 wherein said organometallic compound is zinc naphthenate and resin is a furan modified phenolic resin.

43. The invention in accordance with claim 32 wherein said organometallic compound is zinc naphthenate and resin is a rubber modified phenolic resin.

* * * * *